US005297973A

United States Patent [19]

Gorman

[11] Patent Number: 5,297,973

[45] Date of Patent: Mar. 29, 1994

[54] SAFETY ELECTRICAL CONNECTION APPARATUS

[76] Inventor: Michael P. Gorman, 3430 Highland Dr., Carlsbad, Calif. 92004

[21] Appl. No.: 945,816

[22] Filed: Sep. 15, 1992

[51] Int. Cl.[5] ..... H01R 13/15

[52] U.S. Cl. ..... 439/265; 439/270; 439/536

[58] Field of Search ..... 439/44, 45, 48, 140, 439/265, 269, 269.1, 270, 337, 535, 536

[56] References Cited

U.S. PATENT DOCUMENTS

| | | | |
|---|---|---|---|
| 1,328,224 | 1/1920 | Benjamin . | |
| 2,447,597 | 8/1948 | Reed | 439/536 |
| 2,524,701 | 10/1950 | Grill | 439/269.1 |
| 3,214,726 | 10/1965 | Cardensa et al. . | |
| 3,317,881 | 5/1967 | Setecka . | |
| 3,588,786 | 6/1971 | Alfiero | 439/265 |
| 3,930,704 | 1/1976 | Dekanic . | |
| 4,148,536 | 4/1979 | Petropoulsos et al. | 200/51.09 |
| 4,179,175 | 12/1979 | Farnworth et al. . | |
| 4,230,386 | 10/1980 | Farnworth et al. | 330/42 |
| 4,493,517 | 1/1985 | Hillary . | |
| 4,605,270 | 8/1986 | Aslizadeh | 439/140 |
| 4,617,613 | 10/1986 | Rice | 439/536 X |

*Primary Examiner*—Larry I. Schwartz
*Assistant Examiner*—Khiem Nguyen
*Attorney, Agent, or Firm*—Brown, Martin, Haller & McClain

[57] ABSTRACT

A safety electrical outlet is disclosed which uses a covered outlet box in which the electrical contacts are on the back of the cover, and cannot easily be reached by a person (especially a child) poking into the socket. The contacts in turn form a portion of a circuit with electrically conductive leads and risers from the ordinary business power conduits. The corresponding plug has retractable contact prongs or blades which extend out from the sides of the plug, so that when the plug is inserted into the socket, the sideways-extending blades touch the contacts on the underside of the cover plate and the electrical connection is completed. When it is desired to disengage the plug, the blades are retracted and the plug removed from the socket. Built-in spring-loaded panels cover the plug openings in the cover plate when the plugs are not inserted. There may be a single socket/opening in the cover or there may be two or more ganged openings/sockets. The box, cover and plug may all be colored or decorated as desired.

8 Claims, 2 Drawing Sheets

SAFETY ELECTRICAL CONNECTION APPARATUS

BACKGROUND OF THE INVENTION

1. Field of the Invention

The invention herein relates to electrical outlet boxes and the associated plugs and wiring, particularly such as are used in common residential and commercial buildings.

2. Description of the Prior Art

The ordinary electrical outlet as used in most residences and commercial buildings, with its two exposed electrically "hot" or "live" slots, is very convenient when properly used by adults. For children, however, particularly young children, the ordinary electrical outlet can be a source of serious injury and in many cases death. Children are naturally curious, and it is unfortunately not uncommon for a child to become intrigued with an electrical outlet and probe into it with a piece of metal, such as a piece of tableware, kitchen utensil, letter opener, screw driver or the like. This far too often leads to a tragic result as the metal object contacts the hot electrical leads and closes a ground circuit through the child's body, electrocuting the child.

Parents have sought ways to avoid this problem. Tape can be put over the exposed opening of the sockets, but tape frequently does not adhere for very long and has an unsightly appearance. In any case the tape itself often becomes an attractant to the child who peals it away and exposes the face of the socket. Commercial products, such as plastic caps, are also widely available, and are used by many parents. However, to be effective, such caps must fit very snugly against the socket. They are therefore quite difficult to remove, even for an adult, when one wishes to plug an appliance into the outlet. Consequently, many parents initially start using the caps with good intentions, but after a while tend to start taking them off or discarding them because of the inconvenience when plugging in appliances.

It would clearly be advantageous, therefore, to have a plug and socket system which would be both safe for use with children and convenient for adults to use for its regular connection purposes. Such a plug and socket system should be such that it is generally not an attractant to children, but also such that if a child should deliberately or inadvertently attempt to probe into it, it would very difficult for the child to make contact with live electrical circuits. The electrical connection of the present invention accomplishes those goals.

SUMMARY OF THE INVENTION

The invention herein is a safety electrical outlet which uses a covered outlet box in which the electrical contacts are on the back of the cover, and cannot easily be reached by a person (especially a child) poking into the socket. The contacts in turn form a portion of a circuit with electrically conductive leads and risers from the ordinary business power conduits. The corresponding plug has retractable contact prongs or blades which extend out from the sides of the plug, so that when the plug is inserted into the socket, the sideways-extending blades touch the contacts on the underside of the cover plate and the electrical connection is completed. When it is desired to disengage the plug, the blades are retracted and the plug removed from the socket. Built-in spring-loaded panels cover the plug openings in the cover plate when the plugs are not inserted.

In its broadest form, the invention herein is a safety electrical connection apparatus comprising a connection box having sides and a bottom and being open at the top; a cover having front and back surfaces and adapted to have the back surface removably engage the sides and substantially close the open top, the cover having at least one opening therethrough adapted to receive a plug; electrical connection means within the box contacting electrical wiring external to the box; conduit means within the box to provide an electrical path from the electrical connection means to electrical conductor means on the back surface of the cover, the electrical conductor means extending to a periphery of the opening; a plug having movable electrical contacts which retractably extend outwardly therefrom and are adapted, when the plug is inserted through the opening, to engage the electrical conductor means at the periphery of the opening and complete an electrical circuit therewith; and closure means adapted to be seated in and close the opening when the plug is not inserted through the opening and to be urged away from the opening when the plug is inserted therethrough.

There may be a single socket/opening in the cover or there may be two or more ganged openings/sockets.

The box, cover and plug may all be colored or decorated as desired.

DETAILED DESCRIPTION AND PREFERRED EMBODIMENTS

Figure 1:
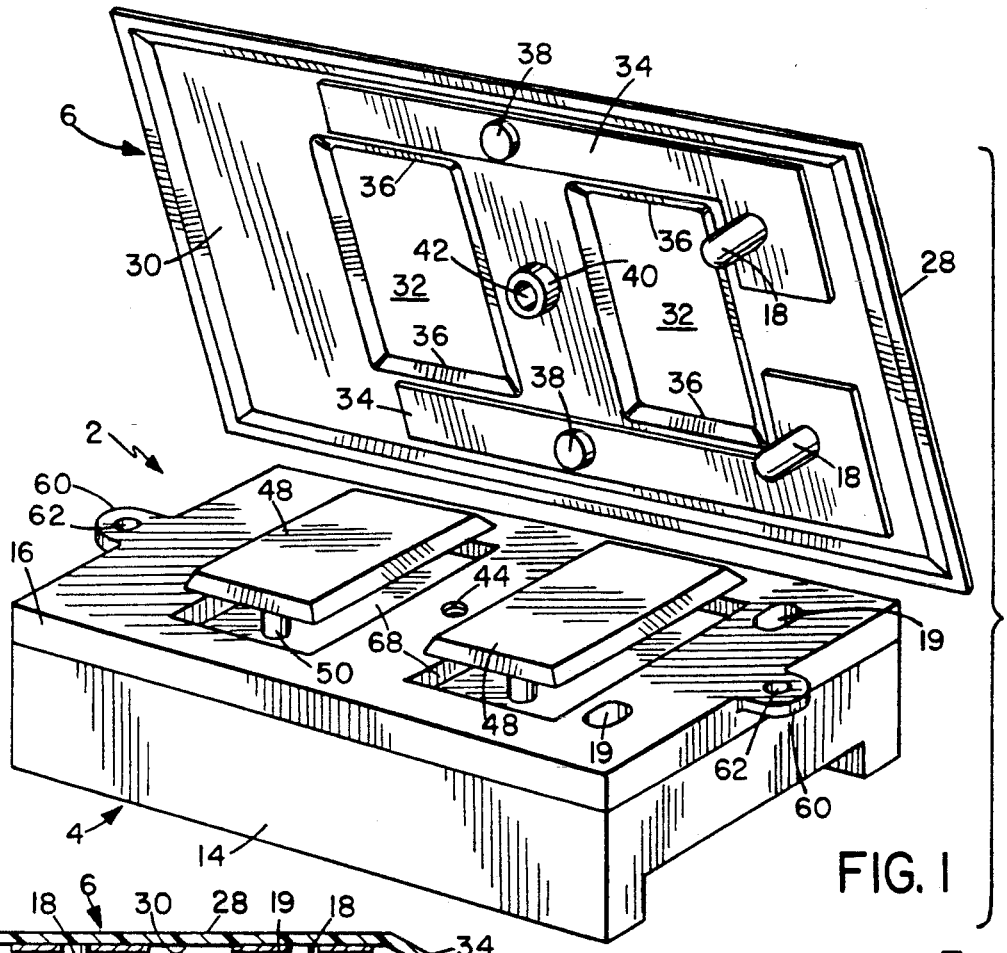
FIG. 1 is a perspective view of the outlet box component of this invention with its cover raised.

The invention herein is best understood by reference to the appended drawings. FIG. 1 shows the connection box or socket side of the apparatus, generally designated 2. This component of the apparatus is formed of a base 4 and a cover 6. The base 4 is designed to fit into a conventional electrical connection opening in a wall 8 or other normal location, either directly itself or by being placed inside of a standard connection box 10, the latter being nailed to a stud or otherwise secured in position. A conventional (usually two- or three-wire) electrical lead or conduit 12 will run to the present apparatus either directly or through the box 10.

Figure 3:
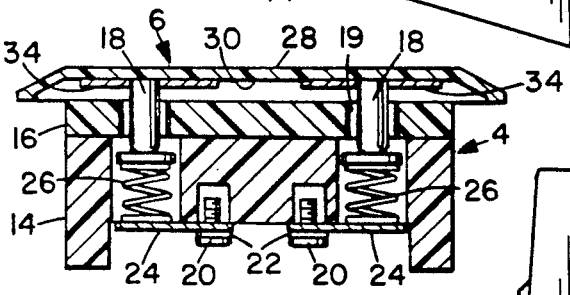
FIG. 3 is a sectional view taken on line 3—3 of FIG. 2.
Figure 4:
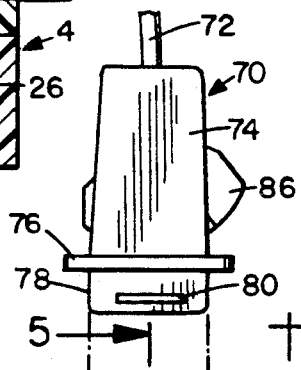
FIG. 4 is a side elevation view of the plug.
Figure 4:
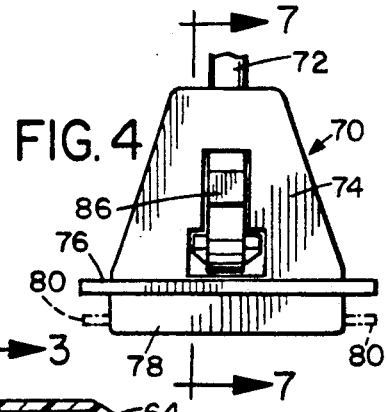
Figure 2:
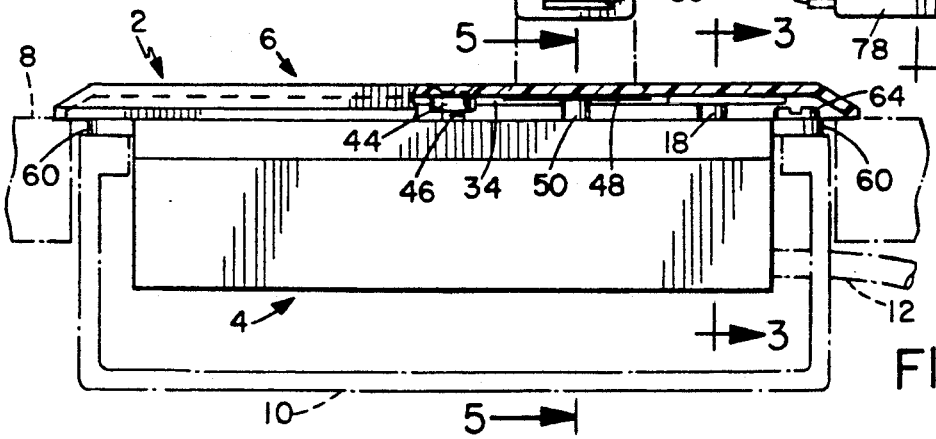
FIG. 2 a side elevation view of the assembled apparatus with the box cover partially cut away, and showing the plug in position for insertion.

The base 4 can be formed in a single piece or with a bottom section 14 and a top section 16 as shown in FIGURE 1. The top section 16 will be perforated with slots 19 to guide and contain downwardly protruding contact prongs 18 which, as will be described, are part of the electrical circuit. As best seen in FIGS. 2 and 3, the outside electric power enters through conduit 12 and the ends of the wires in conduit 12 are secured to screws 20 on the underside of base 4 as indicated at 22. The polarity of the connections is not important, but it will be recognized that the two sides of the circuit need to be kept separated in the same manner as for any electrical circuit. Leading from screws 20 and connections 22 are conductors 24 which are in contact with compression springs 26. Compression springs 26, in turn, insure that consistent pressure is maintained at the point of contact with prongs 18. All of these components will be made of metal or other electrically conductive material (such as carbon), such that each of the risers is a live electrical conduit representing the opposite sides of the circuit.

Cover 6 has a front face 28 and a back surface 30. The front face 28 is the surface which faces outwardly from the wall into a room or other location and is the surface which is the principal portion of the socket side of the apparatus normally visible to a user. Both the base 4 and the cover 6 will normally be made of non-conductive material, usually plastic or hard rubber. They may both be of plain appearance and colored, with the standard commercial colors being white, beige and brown as with prior art outlets. Both however, and especially cover 6, may be of any desired color and may be decorated as desired, to blend in with the decor of the room. As will be described below, the panels 48 which block the openings in the cover will preferably be of the same appearance in order to provide a uniform appearance of the outward appearance and minimize the attraction to children. They may, however, be of contrasting or complementary appearance if desired for decorative purposes.

The cover 6 has at least one and preferably two openings 32 formed through it, in the same manner as found in conventional prior art electrical cover plates. Of course, there may be more than two openings for various ganged outlets. On the underside of cover 6 are electrical contacts 34 to which are attached contact prongs 18. As shown in FIG. 3, these make contact with the compression springs 16 to extend the electrical connections to the edges of the openings 32. By having the prongs 18 on the inside of cover 6, opening of the cover 6 breaks the connection between the prongs 18 and the springs 16. This makes the outlet surface electrically "dead" and therefore safe, since the only live electrical elements are then the recessed springs 16. In the present case, the edges of openings 32 are shown as the lateral edges 36, which is the preferred configuration, but the connections could also be at one or both the opposite edges. The conductors 34 are held in place by non-conductive rivets or screws 38. In the center of the cover 6 is boss 40 with hole 42 therethrough for a mounting screw 46 which passes through hole 42 and is seated in threaded hole 44 in the top 16 of base 4, in a manner analogous to conventional electrical box cover mountings.

Figure 5:
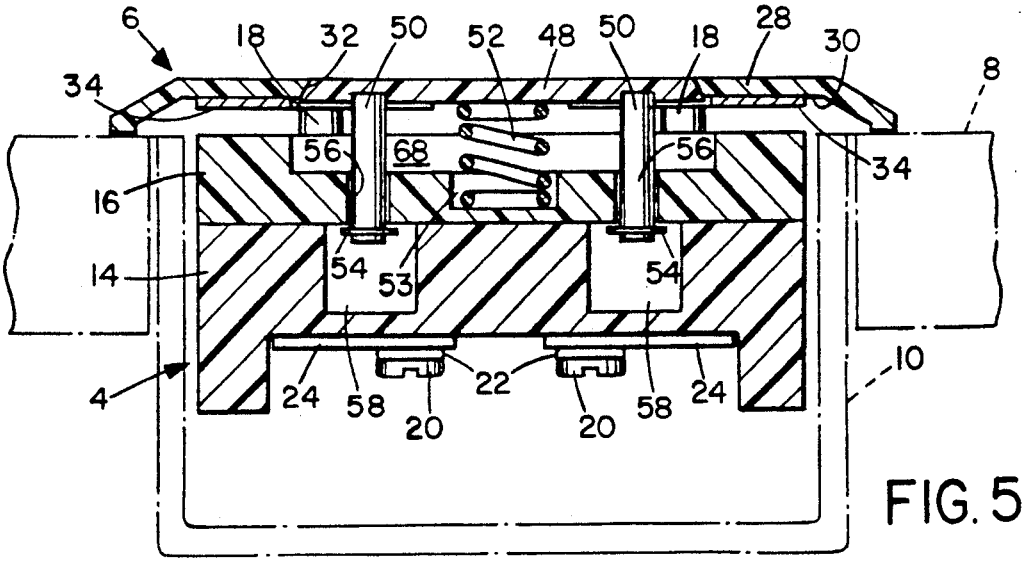
FIG. 5 is an enlarged sectional view taken on line 5—5 of FIG. 2.

Also in base 4 are panels 48 which are mounted on posts 50. Panels 48 are of a configuration to fit into openings 32 when there is no plug in the connected to the socket 2, as best shown in FIG. 5. Each panel 48 is biased outwardly by compression spring 52 which is seated in recess 53 in upper portion 16 of base 4. Each post 50 has a stop 54 which engages the underside of top portion 16 as the post moves through hole 56 so that the panel 48 becomes properly positioned flush with the top surface 28 of the cover 6. Recess 58 in lower portion 14 allows for retraction of the post 50 when a plug is inserted. Recesses 68 are formed in the top surface of top portion 16 to provide a space for retraction of the panels 48 when a plug is inserted. The panels 48 and posts 50 will normally be made of a non-conductive material, commonly the same material as the cover 6. As noted above, the panels 48 will be formed and/or decorated preferably to match the outer surface 28 of the cover 6 but may have a contrasting appearance.

The base 4 will also have mounting lugs 60 with holes 62 to allow them to be attached to the wall or the underlying box 10 as illustrated in FIG. 2 by screws 64. If desired, conductors 24 may be secured at one or more points over their length by screws 66.

A typical plug is illustrated in FIGS. 4 and 6–8. The plug 70 has leading therefrom a wire 72 to the appliance, light or other electrical device (not shown) which is to be plugged into the socket. In its preferred form, the plug 70 has the tapered appearance shown in FIGS. 2 and 4, with one side having a greater taper. There is a outer portion 74, a stop plate 76 and a connection portion 78. The connection portion 78 has essentially the same configuration as the openings 32 in cover 6 and is intended to fit through those openings 32 with slight clearance. The clearance should be such that the plugs will easily pass through the opening 32, but not so great that the plug 70 will be significantly loose in the opening 32.

Figure 6:
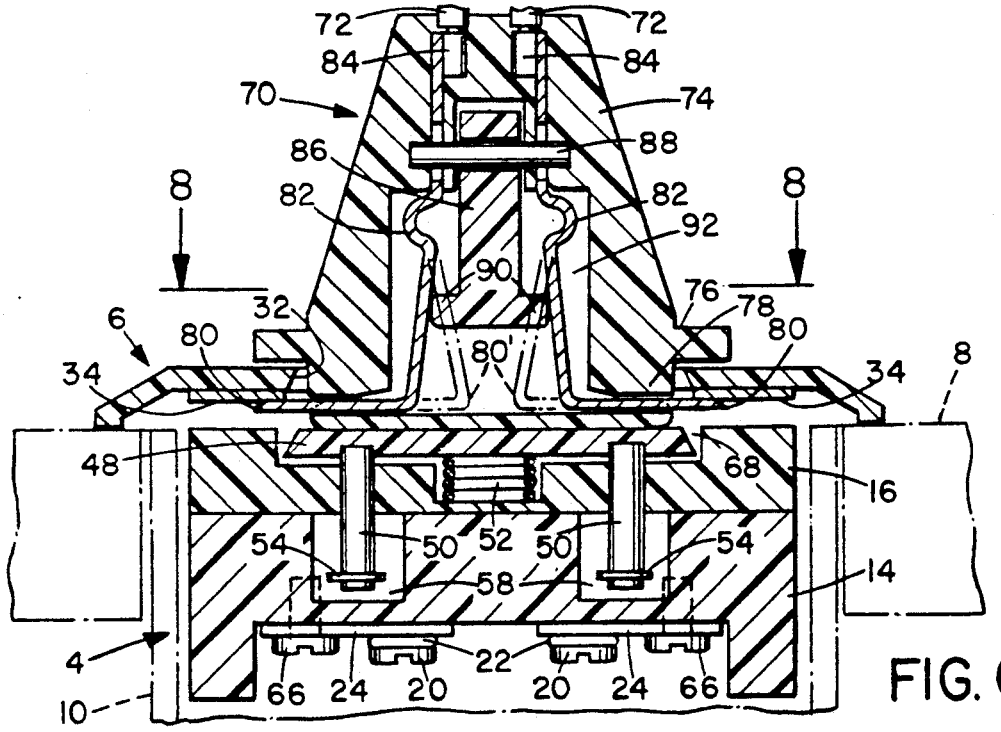
FIG. 6 is a sectional view similar to that of FIG. 5, with the plug shown inserted and locked onto the cover in position to make an electrical connection.

The plug 70 is fitted with retractable/extendable electrical contacts 80. When the plug is placed against the cover 6, the connector portion 78 will pass through the opening 32 to a depth determined by the positioning of stop plate 76, which will halt the travel of the plug when plate 76 comes in contact with the outer surface 28 of the cover 6, the stop plate 76 being formed larger than the openings 32 so that it will not pass there through. During the insertion, the contacts 80 are retracted as shown at 80′ in FIG. 6 in order to allow for clearance for the conductor portion 78 to pass through the openings 32. Once the plug is inserted, the contacts 80 are extended and make physical contact with the conductors 34 as shown in FIG. 6, thus completing the electrical circuit to the appliance, light or other fixture which is now plugged in. The contacts 80 have extensions 82 with pass up through the outer portion of 74 of plug 70 and to which are wires 72 attached by screws, solder, crimped joints or other conventional means, as shown at 84.

Figure 7:
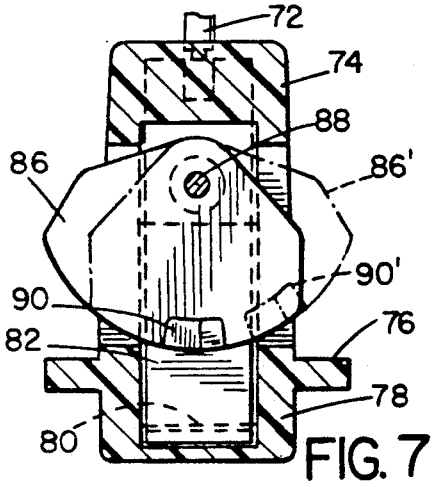
FIG. 7 is an enlarged sectional view taken on line 7—7 of FIG. 4.
Figure 8:
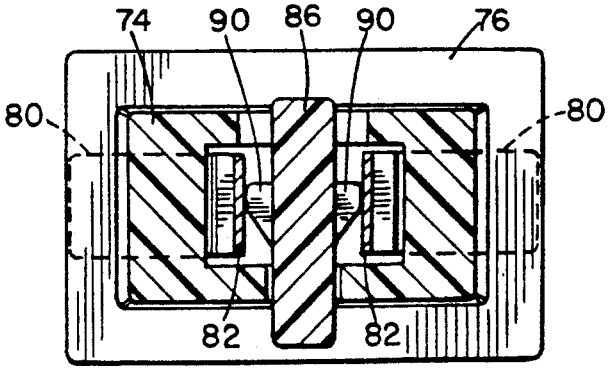
FIG. 8 is a sectional view taken on line 8—8 of FIG. 6.

The extension/retraction actuating mechanism for the plug is shown in FIGS. 7 and 8. An actuating toggle 86 is pivoted on a pivot pin 88 which is mounted in the upper portion 74 of plug 70. In FIG. 7 the cam is shown in the "ON" position in which the electrical contact 80 are extended, as shown in FIG. 8. In this position, the cam extension 90 pushes outwardly on the inside of the contact extension 82 and forces them apart as shown in FIG. 6, thus extending the outer ends of the contacts 80 into contact with the conductors 34. When the cam is moved to the retracted or "OFF" position, as shown at 86′, so that the cam is in position 90′, there is nothing to separate the two contacts and the spring effect of the extensions 82 biases the contacts 80 back into the interior of the plug as shown at 80, The entire mechanism is seated in recess 92 in the body of plug 70.

It will be evident from this description that the plug and socket apparatus of the present invention provides a safe and efficient way to have a electrical connection devices which from the adult user's point of view are equivalent functionally to prior art plug and socket units. However, the devices of the present invention automatically provide child-safe features when the plug is removed. It will be seen that the child is unlikely to be attracted to the outlet, since the panel 48 and the cover 6 will normally show a uniformly colored surface with no apparent openings, and therefore will not attract a child. Even if a child might be attracted, perhaps if panels 48 were of a contrasting color or texture to the cover plate 6, a child inserting his or her finger or a tool into the socket by pushing inwardly on the panel 40 would not be able to make contact with the live conductors 34 without having a suitably thin tool and going to a lot of effort, neither of which is to be expected with a small child. Thus the incidences of electrocution of children will be substantially reduced, if not eliminated entirely, by the system of the present invention.

It will be evident that there are numerous embodiments of the present invention which, while not expressly described above, are clearly within the scope and spirit of the present invention. The above description is therefore intended to be exemplary only and the scope of the present invention is to be defined solely by the appended claims.

I claim:

1. A safety electrical connection apparatus comprising:

a connection box having sides and a bottom and being open at the top;

a cover having front and back surfaces and adapted to having said back surface removably engage said sides and substantially close said top, said cover having at least one opening therethrough adapted to receive a plug, said cover further comprising electrical conductor means on said back surface thereof, said electrical conductor means extending to a periphery of said opening;

electrical connection means within said box contacting electrical wiring external to said box;

conduit means within said box to provide an electrical path from said electrical connection means to said electrical conductor means on said back surface of said cover;

a plug having movable electrical contacts which retractably extend outwardly therefrom and are adapted, when said plug is inserted through said opening, to engage said electrical conductor means on said back surface of said cover at said periphery of said opening and complete and electrical circuit therewith; and closure means adapted to be seated in and close said opening when said plug is not inserted through said opening and to be urged away from said opening when said plug is inserted therethrough.

2. Apparatus as in claim 1 further comprising biasing means to urge said closure means into seated position in said opening.

3. Apparatus as in claim 2 wherein said biasing means comprises a spring.

4. Apparatus as in claim 1 further comprising motion means in said plug to cause said movable electrical contacts to move between a position extended outwardly from said plug and a position recessed within said plug.

5. Apparatus as in claim 4 wherein said motion means comprises a toggle cooperating with a cam, each said movable contact has incorporated therein a cam follower engaging said cam, and movement of said toggle transmitted through said cam and cam follower causes said contacts to move alternately outwardly and inwardly of said plug.

6. Apparatus as in claim 1 wherein there are a plurality of said openings in said cover, said electrical conductor means form an electrical path to the periphery of each said opening, and insertion of plugs into each respective opening forms parallel electrical circuits.

7. Apparatus as in claim 1 wherein said electrical connection means within said box to said electrical wiring external to said box are at the bottom of said box, and said box further comprises riser means within said box, each said riser containing an electrical conductor to form said electrical path from said electrical connection means to said electrical conductor on said back surface of said cover.

8. Apparatus as in claim 1 further comprising means to secure said apparatus into position in a building wall.

* * * * *